US011788780B2

(12) United States Patent
Kontu et al.

(10) Patent No.: US 11,788,780 B2
(45) Date of Patent: Oct. 17, 2023

(54) MODULAR ARRANGEMENT FOR USE IN A VAPOR-COMPRESSION REFRIGERATION SYSTEM

(71) Applicants: VAHTERUS OY, Kalanti (FI); MAYEKAWA EUROPE NV/SA, Zaventem (BE)

(72) Inventors: Mauri Kontu, Kalanti as. (FI); Jean-Pierre Boone, Ternat (BE)

(73) Assignees: VAHTERUS OY, Kalanti (FI); MAYEKAWA EUROPE NV/SA, Zaventem (BE)

( * ) Notice: Subject to any disclaimer, the term of this patent is extended or adjusted under 35 U.S.C. 154(b) by 378 days.

(21) Appl. No.: 17/284,361

(22) PCT Filed: Oct. 10, 2019

(86) PCT No.: PCT/EP2019/077473
§ 371 (c)(1),
(2) Date: Apr. 9, 2021

(87) PCT Pub. No.: WO2020/074640
PCT Pub. Date: Apr. 16, 2020

(65) Prior Publication Data

US 2021/0341191 A1 Nov. 4, 2021

(30) Foreign Application Priority Data

Oct. 12, 2018 (EP) ..... 8200127

(51) Int. Cl.
*F25B 43/02* (2006.01)
*F25B 13/00* (2006.01)

(52) U.S. Cl.
CPC ..... *F25B 43/02* (2013.01); *F25B 13/00* (2013.01)

(58) Field of Classification Search
CPC ..... F25B 43/02; F25B 13/00; F25B 1/005; F25B 39/00; F25B 2400/02;
(Continued)

(56) References Cited

U.S. PATENT DOCUMENTS

2017/0261227 A1* 9/2017 Mohideen ..... F25B 43/02

FOREIGN PATENT DOCUMENTS

CN 102252463 A 11/2011
CN 102345944 A 2/2012
(Continued)

OTHER PUBLICATIONS

International Search Report for PCT/EP2019/077473 dated Jan. 7, 2020, 3 pages.
(Continued)

*Primary Examiner* — Len Tran
*Assistant Examiner* — Kamran Tavakoldavani
(74) *Attorney, Agent, or Firm* — NIXON & VANDERHYE

(57) ABSTRACT

A modular arrangement for use in vapor-compression refrigeration system includes an evaporator, oil separator, condenser and oil cooler, arranged inside an outer casing with a longitudinal cylindrical shell and the end plates in both ends of the shell. The shell includes three separate parts, separated from each other by arranging first and second partition walls between the parts. The first part includes the evaporator, the second part includes the oil separator and the third part includes the oil cooler and the condenser. The third part including a combination of the oil cooler and the condenser is constructed by arranging one plate pack into the third part, which is divided two functional plate pack parts by an intermediate plate arranged between the heat
(Continued)

exchange plates of the plate pack. The first plate pack part functions as oil cooler and the second plate pack part functions as the condenser.

20 Claims, 3 Drawing Sheets

(58) Field of Classification Search
CPC ..... F25B 2400/21; F25B 2500/21; F25B 2339/044; F25B 2400/16; F25B 2400/23
See application file for complete search history.

(56) References Cited

FOREIGN PATENT DOCUMENTS

| | | |
|---|---|---|
| EP | 0 542 577 | 5/1993 |
| FR | 2 317 117 | 2/1977 |
| FR | 2 526 137 | 11/1983 |
| JP | S50-82760 U | 7/1975 |
| JP | S57-148678 | 9/1982 |
| JP | 2001-174102 A | 6/2001 |
| JP | 2008-267730 | 11/2008 |

OTHER PUBLICATIONS

Written Opinion of the ISA for PCT/EP2019/077473 dated Jan. 7, 2020, 6 pages.
European Search Report for EP 18 20 0127 dated Mar. 15, 2019, 3 pages.
Office Action issued in Japanese Patent Application No. 2021-517479 dated Jul. 25, 2023.

* cited by examiner

MODULAR ARRANGEMENT FOR USE IN A VAPOR-COMPRESSION REFRIGERATION SYSTEM

CROSS-REFERENCE TO RELATED APPLICATIONS

This application is the U.S. national phase of International Application No. PCT/EP2019/077473 filed Oct. 10, 2019 which designated the U.S. and claims priority to EP 18200127.1 filed Oct. 12, 2018, the entire contents of each of which are hereby incorporated by reference.

FIELD OF THE INVENTION

The present invention relates to a modular arrangement for use in vapor-compression refrigeration system according to the independent claim presented below.

BACKGROUND OF THE INVENTION

Vapour-compression units are the most widely used refrigeration systems. The vapor-compression uses a circulating refrigerant as the medium which absorbs and removes heat from the space to be cooled and subsequently rejects that heat elsewhere. The vapor-compression refrigeration system comprises four main components: a compressor, a condenser, an expansion device (also called a throttle or expansion valve), and an evaporator. Further, the system typically comprises an oil separator, since the compressor needs oil to work properly.

The vapor-compression refrigeration systems are closed systems, wherein the refrigerant circulates and undergoes phase changes. In vapor-compression refrigeration systems, circulating refrigerant is compressed to a higher pressure, resulting a higher temperature as well. The hot, compressed refrigerant gas is then at a temperature and pressure at which it can be condensed with cooling medium, such as cooling water or cooling air. This is a phase of the vapor-compression refrigeration system, wherein the circulating refrigerant rejects heat from the system and the rejected heat is carried away. Since compressor needs oil to lubricate and seal the compressor parts, the oil is mixed during the compression process with refrigerant. The oil accumulation to the refrigeration system, mainly in flooded evaporator, should be prevented and therefore the oil separator is used to separate oil from hot refrigerant gas coming from compressor. Excess oil in the system may reduce the efficient of the refrigeration process. The separated oil flows to the oil cooler and then it is directed back to compressor. The refrigerant gas from compressor and oil separator will be condensed in condenser while the cooling medium is heated. From condenser, the refrigerant continues in liquid form to the expansion device. Expansion device lowers the pressure and then the refrigerant is directed back to the evaporator. Evaporator evaporates refrigerant that is led to the compressor. Evaporation process needs heat that is taken from the matter that will be cooled during the refrigeration process.

Commonly, all main components of the vapor-compression refrigeration system are located separately, as own equipment. The oil separator is commonly arranged below the compressor, and the evaporator and the condenser are arranged at adjacent of the compressor. Therefore, the space required for the vapor-compression refrigeration system is remarkable, both the area and the space in height direction. The components of the refrigeration machine arrangement located separately from each other require also pipework for circulating a refrigerant from one component to another, which also increase a space required for the arrangement.

SUMMARY OF THE INVENTION

It is an object of the present invention to reduce or even eliminate the above-mentioned problems appearing in prior art.

An object of the present invention is to provide an arrangement for use in vapor-compression refrigeration cycle, which arrangement makes possible to decrease the size of the refrigeration system.

It is especially an object of the present invention to provide a compact modular structure for use in vapor-compression refrigeration system, which decrease a number of the separate components of the vapor-compression refrigeration system.

Further, it is an object of the present invention to provide a modular structure for use in vapor-compression refrigeration system, which can be easily manufactured using standard sized parts of heat exchangers and standard oil separation components.

In order to achieve among others the objects presented above, the invention is characterized by what is presented in the enclosed independent claims. Some preferred embodiments of the invention will be described in the other claims.

A typical arrangement according to the present invention for use in vapor-compression refrigeration system comprises an evaporator, an oil separator, a condenser and an oil cooler, which are arranged inside an outer casing that comprises a longitudinal cylindrical shell and the end plates arranged at both ends of the shell, and the shell comprises three separate parts, which are separated from each other by arranging a first partition wall and a second partition wall between the parts, wherein the first part comprises the evaporator, the second part comprises the oil separator and the third part comprises the oil cooler and the condenser. The third part of the arrangement according to the invention comprising the oil cooler and the condenser is constructed by arranging one plate pack into the third part, which plate pack is divided two functional plate pack parts by arranging an intermediate plate between the heat exchange plates of said plate pack, wherein the first plate pack part functioning as oil cooler and the second plate pack part functioning as the condenser.

A typical vapor-compression refrigeration system comprises at least

- an arrangement according to the invention, which comprises an evaporator, an oil separator, a condenser and an oil cooler,
- a compressor,
- means for leading a refrigerant circulating in the system from the evaporator to the compressor, from the compressor to the oil separator and from the condenser to the evaporator,
- means for conveying oil from the oil separator to the oil cooler, and from the oil cooler to the compressor, and
- an expansion device through which the refrigerant circulating in the system is lead from the condenser to the evaporator.

The present invention is based on a modular structure, which combines most of the main components of the vapor-compression refrigerating system inside one outer casing. The invention combines inside the same outer casing at least the following components: an evaporator, an oil separator, a condenser and an oil cooler. Compressor and expansion device of the refrigeration machine are arranged separately from the arrangement of the present invention. The modular structure according to the invention is advantageous because arranging said main components inside the same outer casing provides compact structure for the refrigeration machine, which requires less space for components. An arrangement according to the invention may decrease both the area and the space in height direction required for the refrigeration system. Further an arrangement according to the invention for use in the vapor-compression refrigerating system requires less separate components, which also may reduce manufacturing costs. An arrangement according to the present invention is an integral structure, thereby also decreasing pipework for circulating a refrigerant from one component to another, and it can be easily assembled.

It has been found that the modular structure according to the present invention can be constructed by arranging a first partition wall and a second partition wall between the separate module parts and e.g. by using welded Plate and Shell-type heat exchangers in evaporator and condenser/oil cooler parts of the modular structure. A pressure proof partition walls makes possible to arrange separate operational functions on both sides of the partition walls and so they can be arranged inside the same outer casing. Using the standard size heat exchange plates and one common outer casing provides also cost-effective way to produce vapor-compression refrigeration systems. In addition, one part of the modular structure is constructed so that it comprises two separate operational functions, a condenser and an oil cooler in one module part of the arrangement, which means that the condenser and the oil cooler are arranged to same plate pack and they have a shared shell side. This structure also decreases the size of the arrangement and simplifying piping of the arrangement.

DESCRIPTION OF THE DRAWINGS

The invention will be described in more detail with reference to appended drawings, in which.

DETAILED DESCRIPTION OF THE INVENTION

Figure 1:
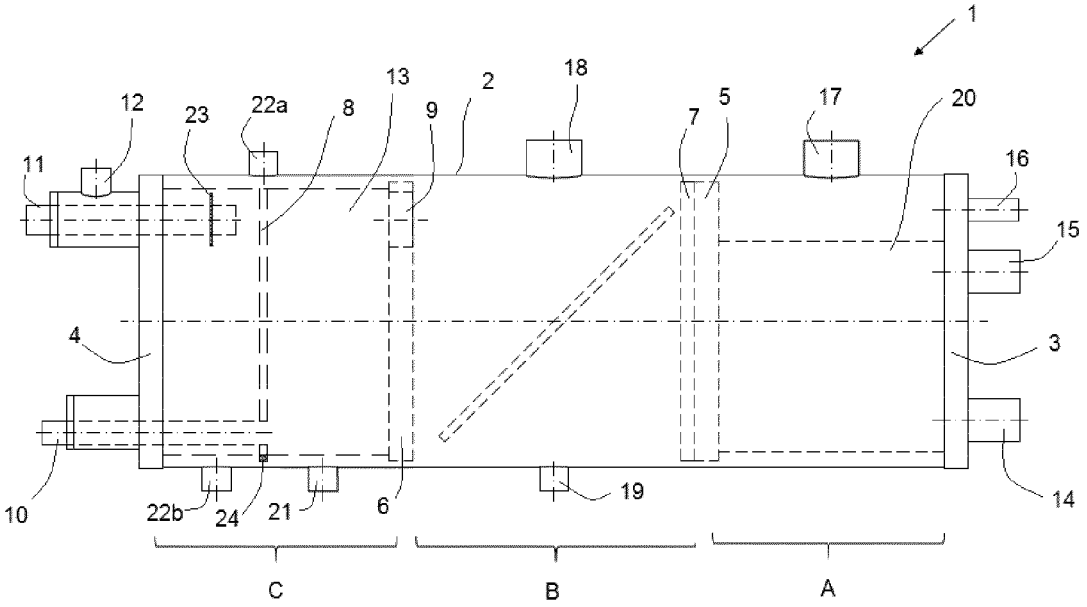
FIG. 1 shows a modular arrangement according to an embodiment of the invention for use in vapor-compression refrigeration system.

An arrangement according to the invention comprises an evaporator, an oil separator, a condenser and an oil cooler arranged inside one longitudinal outer casing that comprises a longitudinal cylindrical shell and the end plates arranged at both ends of the shell, wherein the outer casing is the enclosed structure. A longitudinal cylindrical shell comprises three separate parts, which are separated from each other by arranging a first partition wall and a second partition wall between the parts, wherein the first part comprises the evaporator, the second part comprises the oil separator and the third part comprises a combination of the oil cooler and the condenser. The arrangement according to a preferred embodiment of the invention is composed from three separate module parts, wherein the shell has been divided to three separate parts by arranging a first partition wall and a second partition wall between the module parts. An arrangement according to the invention may comprise more than three modules, but it comprises at least the first part functioning as the evaporator, the second part functioning as the oil separator and the third part functioning as a combination of the oil cooler and the condenser inside the same outer casing.

According to a preferred embodiment of the invention, a shell of the outer casing is a substantially horizontal cylindrical shell and the end plates are vertical end plates. The outer casing comprises end plates in the both ends of the shell, namely a first end plate and a second end plate. A longitudinal direction of the outer casing or cylindrical shell used in this description typically refers to the horizontal direction. For example, if the cylindrical shell of the outer casing is a straight circular cylinder, then its longitudinal direction is the same as the direction of the central axis of the cylinder in question.

In an embodiment according to the invention an evaporator, an oil separator, a condenser and an oil cooler are arranged inside one uniform longitudinal cylindrical shell, which means that the shell is continuous shell from the first end plate to the second end plate of the outer casing, i.e. the shell is uniform in the longitudinal direction of said shell, and the shell is divided in the longitudinal direction of the shell to three separate parts by arranging a first partition wall and a second partition wall between the parts inside the shell. The partition walls are attached, preferably welded, to the inner surface of the shell. In another embodiment, a longitudinal cylindrical shell of the outer casing may be constructed from two or more parts, wherein the shell is continuous covering at least one module part of the arrangement. Especially, when the size of the arrangement is increased, the shell may be constructed from two or more separate parts which are attached, preferably welded to each other, wherein they form the longitudinal cylindrical shell of the outer casing. When the shell of the outer casing is formed from two or more parts, the first and the second partition wall may be arranged to the structure so that they are between the parts of the shell. According to the invention, the shell of the outer casing is constructed so that the diameter of the longitudinal cylindrical shell is substantially same in all module parts of the arrangement, i.e. the diameter of the shell of outer casing is substantially same from the first end plate to the second end plate of the outer casing.

Typically, in an arrangement according to the invention the outer casing functioning as a pressure vessel. In a preferred embodiment of the invention, a first partition wall and a second partition wall of the arrangement are pressure-proof walls.

A thickness of the partition walls is dependent on the diameter of the shell and/or a required pressure rating of the arrangement. Also, a thickness of the shell may vary, and it is dependent on a required pressure rating of the arrangement. In an embodiment according to the invention, the thickness of the partition walls may be in the range of 20-100 mm or 40-100 mm. A thickness of a first partition wall and a second partition wall may differ from each other. A first partition wall and a second partition wall are typically made of same material as the outer casing. An outer casing and partition walls are typically made of e.g. steel, stainless steel, carbon steel or other suitable metal for the purpose. A first and a second partition wall are typically walls having substantially same thickness in the whole partition wall.

In a preferred embodiment according to the invention, a first partition wall between the first part functioning as an evaporator and the second part functioning as an oil separator further comprises an insulation layer. It has been found that the evaporator and the oil separator parts can be arranged adjacent module parts inside the same outer casing, especially when the partition wall between them is an insulated partition wall. The insulated partition wall between the evaporator and the oil separation parts is used due to the temperature difference between the evaporator and the oil separator during the operation of the vapor-compression refrigeration cycle. The insulated partition wall decreases or eliminates thermal conduction between the module parts of the arrangement. As an exemplary embodiment, a temperature inside the first part functioning as an evaporator may be about −3-10° C. and a temperature inside the second part functioning as an oil separator may be about 100° C., when using ammonia as a refrigerant. The elimination of the thermal conduction between the module parts is important since otherwise in the evaporator may happen uncontrolled evaporation due to increasing of temperature. In oil separation part the insulated partition wall eliminates a formation of the cold surfaces between said module parts and so eliminating a condensation of the refrigerant inside the oil separator. The insulated partition wall between the evaporator and the oil separation parts ensures that oil separation from hot refrigerant gas can be carried out efficiently.

In a typical embodiment, the insulation layer is arranged on the side of the oil separator. In a preferred embodiment according to the invention, an insulation layer is arranged on a surface of the partition wall and it covers substantially the whole area of the partition wall inside the shell. In a typical embodiment an insulation layer is in contact with hot refrigerant gas inside the oil separator. According to the invention, the insulation layer can be made of any suitable insulation material having an adequate resistance to temperature and chemical condition present in the oil separator. In an exemplary embodiment, an insulation layer may be made of polymer-based insulation material having sufficient heat insulation properties.

A first part and a third part of the modular arrangement according to the invention comprise plate heat exchangers. A first part of the modular arrangement according to the invention comprises a plate pack functioning as an evaporator. A third part of the modular arrangement according to the invention comprises a plate pack functioning as a combination of a condenser and an oil cooler. In a typical embodiment of the invention the plate packs of the first part functioning as an evaporator and the third part functioning as a combination of a condenser and an oil cooler can be manufactured using a normal welded structure composed of circular heat exchange plates. For example, the welded plate pack consisting of circular heat exchange plates which is used in Plate and Shell-type heat exchangers, can be used as the plate pack. These plate packs are made up of several plate pairs. Each plate pair is typically formed of two circular heat exchange plates that are attached, preferably welded together at least at their outer periphery. Each heat exchange plate has at least two openings for the flow of the first heat exchange medium. Adjacent plate pairs are attached together by attaching the openings of two adjacent plate pairs to each other. Thus, the first heat exchange medium can flow from a plate pair to another via the openings inside the plate pack of the heat exchanger, wherein there is flow passages formed of the openings of the heat exchange plates arranged on top of each other. The second heat exchange medium is arranged to flow inside the shell in the spaces between the plate pairs. The inlet and outlet connection of the first heat exchange medium are arranged in connection with the inner parts of the plate pack, i.e. inner parts of the plate pairs. The primary circuit of the plate heat exchanger is thus formed between the inlet and outlet connection of the first heat exchange medium. The inlet and outlet connections for the second heat exchange medium are arranged in connection with the inner side of the shell, i.e. with the outer side of the plate pairs of the plate pack. In other words, the secondary circuit of the plate heat exchanger is formed between the inlet and outlet connection of the second heat exchange medium, inside the shell, in the spaces between the plate pairs. Typically, the primary and secondary circuits are separate from each other, i.e. the first heat exchange medium flowing in the inner part of the plate pack cannot get mixed with the second heat exchange medium flowing in the shell, i.e. outside the plate pack. Thus, the first primary side heat exchange medium flows in every other plate space and the second secondary side heat exchange medium flows in every other plate space of the plate heat exchanger.

In an embodiment according to the invention, the plate packs used in the first and the third parts are mainly circular cylinders in shape, wherein a longitudinal direction of the plate pack is substantially same as the longitudinal direction of the cylindrical shell. In other words, a plate pack formed by heat exchange plates arranged on top of each other is arranged inside the functional part of cylindrical shell so that the longitudinal direction of the plate pack is the same as the longitudinal direction of the cylindrical shell. Since the plate pack components used in the arrangement according to the invention can be standard parts or otherwise commonly used, the manufacturing costs of the arrangement according to the invention can be kept low.

In a preferred embodiment of the invention, an evaporator of the arrangement is a flooded evaporator. A plate pack functioning as a flooded evaporator is arranged in the first part of the arrangement. In an embodiment, a plate pack is arranged in lower part of the first functional part. In an embodiment according to the invention a droplet separator may also be arranged inside the first part above the plate pack. In an embodiment according to the invention, an arrangement may comprise a droplet separator, which is a separate equipment arranged between the evaporator and the compressor. The droplet separator is used in the refrigeration cycle to ensure that refrigerant droplets are not carried to the compressor. The first part of the arrangement further comprises an inlet connection and an outlet connection for leading a heat exchange medium into and out from the plate pack functioning as an evaporator, which inlet and outlet connections are typically arranged through the end plate of the outer casing. A first part of the arrangement functioning as an evaporator further comprises an inlet connection for leading a refrigerant to be vaporised into the first part and an outlet connection for leading the vaporised refrigerant out from the first part, which inlet and outlet connection can be arranged through the shell and/or the end plate of the outer casing depending on the structure of the evaporator.

In a preferred embodiment of the invention the second part of the arrangement comprising an oil separator is a central part of the longitudinal outer casing since then piping from one module part to another can be carried out the simplest way in the flow direction of the refrigerant in the vapor-compression refrigeration cycle. A second part functioning as an oil separator comprises means for oil separation. Further, it comprises an inlet connection for leading hot refrigerant gas from compressor into the second functional part and an outlet connection for leading separated oil out from the oil separator. In a vapor-compression refrigeration cycle, the oil may be mixed during the compression process with the refrigerant. Typically, an inlet connection is arranged at the upper part of the second functional part and an outlet connection is arranged at the bottom part of the second functional part. In an arrangement according to the invention, the separated oil is conveyed from oil separation to the oil cooler arranged in the third part of the modular arrangement and from the oil cooler oil is directed back to the compressor.

In an arrangement according to the present invention the third part of the arrangement comprises a plate pack functioning as a combination of a condenser and an oil cooler. The third part is constructed by arranging one plate pack into the third part, which plate pack is divided two functional plate pack parts by arranging an intermediate plate into to plate pack between heat exchange plates. The plate pack of the third part comprises a first plate pack part and a second plate pack part, wherein the first plate pack part functioning as an oil cooler and the second plate pack part functioning as a condenser. An intermediate plate is arranged between the heat exchange plates so that it blocks the flow connections of the first plate pack part and the second plate pack part via the flow channels formed by the opening of the heat exchange plates. An intermediate plate is arranged between the heat exchange plates so that the outer edge of the intermediate plate is substantially in a same plane with the outers surface of the plate pack. In a preferred embodiment according to the invention a shell side of third part is shared for both plate pack parts, which means that they have common shell side circulation, wherein the third part comprises an inlet connection and an outlet connection for medium flowing in the shell side of the third part. The shell side connections can be arranged through the shell and/or the end plate of the outer casing.

In a preferred embodiment according to the invention an inlet connection for leading the refrigerant into the plate pack functioning as condenser in the third module part is arranged through the partition wall between the second part and the third part of the arrangement, and an outlet connection for leading the condensed refrigerant out from the plate pack functioning as condenser in the third module part is arranged through the intermediate plate of the plate pack in the third module part and the outlet connection pipe is arranged inside a flow passage the first plate pack part functioning as oil cooler in the third module part and the outlet connection pipe is arranged to elongate through the end plate of the outer casing. An inlet connection is possible to arrange through the partition wall between the second part and the third part of the arrangement, since the oil separator and the condenser functions as substantially same pressure. Arranging the inlet connection through the partition wall simplifies the structure of refrigeration arrangement, since no separate piping from the oil separator to the condenser is required. An outlet connection pipe of the second plate pack part has outer diameter smaller than a diameter of the flow passage of the plate pack and an end of the outlet connection pipe of the second plate pack part is attached to the intermediate plate of the plate pack for forming a connection to the flow channel of the second plate pack part. In a preferred embodiment according to the invention described above, a refrigerant to be condensed is arranged to flow inside the plate pack of the second plate pack part of the third part, i.e. a refrigerant is a first heat exchange medium flowing inner parts of the plate pack. A refrigerant to be condensed is arranged to flow from an inlet connection of the second plate pack part through the plate pack to the outlet connection of the second plate pack part, and condensation takes place in pack side of the heat exchanger.

In an embodiment according to the invention an inlet connection of the plate pack part functioning as an oil cooler in the third module part is arranged inside an outlet connection of the plate pack functioning as an oil cooler, wherein the inlet and outlet connections are arranged through the same opening in the end plate of the outer casing. Oil to be cooled circulates in the plate pack side of the first plate pack part of the third module part. Inlet connection pipe elongates inside the flow channel of the plate pack and it is arranged tightly to the flow passage of the plate pack, wherein oil to be cooled can be circulated through the plate pack part so that the inlet connection pipe is arranged inside the outlet connection. An inlet connection pipe has outer diameter smaller than a diameter of the flow passage and the outlet connection.

The plate pack structure of the third part of the arrangement according to the invention makes possible two separate functions inside the same module part, and the inlet and/or outlet connections can be easily arranged in the end plate of the outer casing wherein the space required by the arrangement decreases.

In the first part and the third part of the arrangement according to the present invention any commonly used heat exchange medium can be used as heating/cooling medium in the heat exchangers.

Dimensions of the arrangement according to the invention may vary depending on the application.

A vapor-compression refrigeration system according to the present invention comprises at least

- an arrangement according to the present invention, which comprises an evaporator, an oil separator, a condenser and an oil cooler,
- a compressor,
- means for leading a refrigerant circulating in the system from the evaporator to the compressor, from the compressor to the oil separator and from the condenser to the evaporator,
- means for conveying oil from the oil separator to the oil cooler, and from the oil cooler to the compressor, and
- an expansion device through which the refrigerant circulating in the system is lead from the condenser to the evaporator.

A compressor used in the system may be any suitable compressor, it may be e.g. oil injected screw compressor. A vapor-compression refrigeration system according to the present invention may further comprise a droplet separator as a separate equipment, wherein it is arranged between the evaporator and the compressor in vapor-compression refrigeration cycle.

A vapor-compression refrigeration system according to the present invention is a closed loop system, in which system a refrigerant circulates in the closed cycle and undergoes phase changes.

In a vapor compression refrigeration system according to the invention, a refrigerant may be any suitable refrigerant. In a vapor-compression refrigeration system according to an embodiment of the invention, a refrigerant circulating in the system may be ammonia, wherein it may also be called as ammonia chiller system. Ammonia chiller systems may be used e.g. in large cold storages, process systems.

DETAILED DESCRIPTION OF THE DRAWINGS

Figure 2:
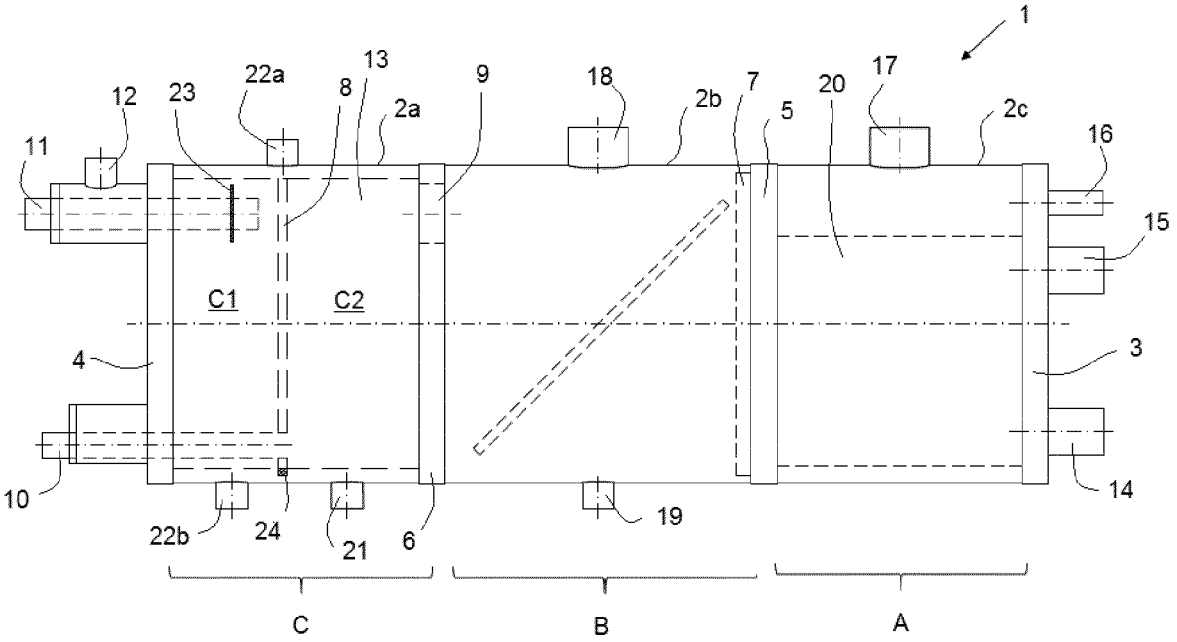
FIG. 2 shows a modular arrangement according to another embodiment of the invention for use in vapor-compression refrigeration system.

FIG. 1 and FIG. 2 present modular arrangements according to the invention for use in vapor-compression refrigeration system. Same reference numbers are used in the Figures. The embodiments presented in FIG. 1 and FIG. 2 comprises similar modular structures, only the shell of the outer casing is constructed in different way.

An arrangement 1 according to the present invention comprises an evaporator, an oil separator, a condenser and an oil cooler, which are arranged inside an outer casing that comprises a longitudinal cylindrical shell 2 and the vertical end plates 3, 4 in the both ends of the shell. The shell is divided three separated module parts A, B, C which are separated from each other by arranging a first partition wall 5 and a second partition wall 6 between the parts. A first part A of the arrangement comprises the evaporator, the second part B comprises the oil separator and the third part C comprises the oil cooler and the condenser.

A shell 2 of the outer casing may be a uniform longitudinal shell 2 from a first end plate 3 to the second end plate 4, as illustrated in FIG. 1. A shell 2 of the outer casing may also be constructed from two or more parts 2*a*, 2*b*, 2*c*, wherein the shell is continuous covering at least one functional part A, B, C of the arrangement. In FIG. 2, a shell is formed of three separate parts 2*a*, 2*b*, 2*c* and a first partition wall 5 and a second partition wall 6 are arranged between the parts.

The third part C of the arrangement 1 comprises a combination of the oil cooler and the condenser, which are constructed by arranging one plate pack 13 into the third part, which plate pack 13 is divided two plate pack parts C1, C2 by an intermediate plate 8, which is arranged between the heat exchange plates of said plate pack. A first plate pack part C1 functioning as an oil cooler and a second plate pack part C2 functioning as a condenser.

A plate pack 20 functioning as a flooded evaporator is arranged at a lower part of the first part A of the arrangement 1. In an embodiment according to the invention a droplet separator may also be arranged inside the first part A above the plate pack (not shown in Figures). The first part A further comprises an inlet connection 14 and an outlet connection 15 for leading a heat exchange medium into and out from the plate pack 20 functioning as an evaporator, which inlet and outlet connections 14, 15 are typically arranged through the end plate 3 of the outer casing. A first part A of the arrangement further comprises an inlet connection 16 for leading a refrigerant to be vaporised into the first part and an outlet connection 17 for leading the vaporised refrigerant out from the first part, which inlet and outlet connections can be arranged through the shell 2 and/or the end plate 3 of the outer casing.

A second functional part B of the arrangement 1 comprising an oil separator is a central part of the longitudinal outer casing of the arrangement 1. A second part functioning as an oil separator comprises means for oil separation. Further, it comprises an inlet connection 18 for leading hot refrigerant gas from compressor into the second functional part and an outlet connection 19 for leading separated oil out from the oil separator. Typically, an inlet connection 18 is arranged in the upper part of the second functional part B and an outlet connection 19 is arranged at the bottom part of the second functional part B.

A third functional part C of the arrangement 1 comprises a plate pack 13 functioning as a combination of a condenser and an oil cooler. In a preferred embodiment according to the invention a shell side of third part C is shared for both plate pack parts C1, C2, which means that they have common shell side circulation, wherein the third part comprises an inlet connection 21 and an outlet connection 22*a*, 22*b* for medium flowing in the shell side of the third part. The shell side connections 21, 22*a*, 22*b* can be arranged in the shell 2 and/or the end plate 4 of the outer casing. As illustrated in FIGS. 1 and 2, the shell side may be divided by a gasket or plate structure 24 for multiple passes. An inlet connection 9 for leading the refrigerant into the plate pack part C2 functioning as condenser is arranged through the partition wall 6 between the second part B and the third part C of the arrangement. An outlet connection 10 for leading the condensed refrigerant out from the plate pack part C2 is arranged through the intermediate plate 8 of the plate pack and the outlet connection pipe is arranged inside a flow passage the first plate pack part C1 functioning as oil cooler and it is arranged to elongate through the end plate 4 of the outer casing. An outlet connection pipe 10 of the second plate pack part C2 has outer diameter smaller than a diameter of the flow passage of the plate pack. An end of the outlet connection pipe 10 of the second plate pack part is attached to the intermediate plate 8 for forming a connection to the flow channel of the second plate pack part C2.

An inlet connection 11 of the plate pack part C1 functioning as oil cooler is arranged inside an outlet connection 12 of the plate pack functioning as oil cooler, wherein the inlet and outlet connections 11, 12 are arranged through the same opening in the end plate 4 of the outer casing. Inlet connection pipe 11 elongates inside the flow channel of the plate pack and an end of the inlet connection pipe 11 is arranged tightly to the flow passage of the plate pack by using a structure 23, wherein oil can be circulated through the plate pack so that the inlet connection pipe 11 is arranged inside the outlet connection 12.

Figure 3:
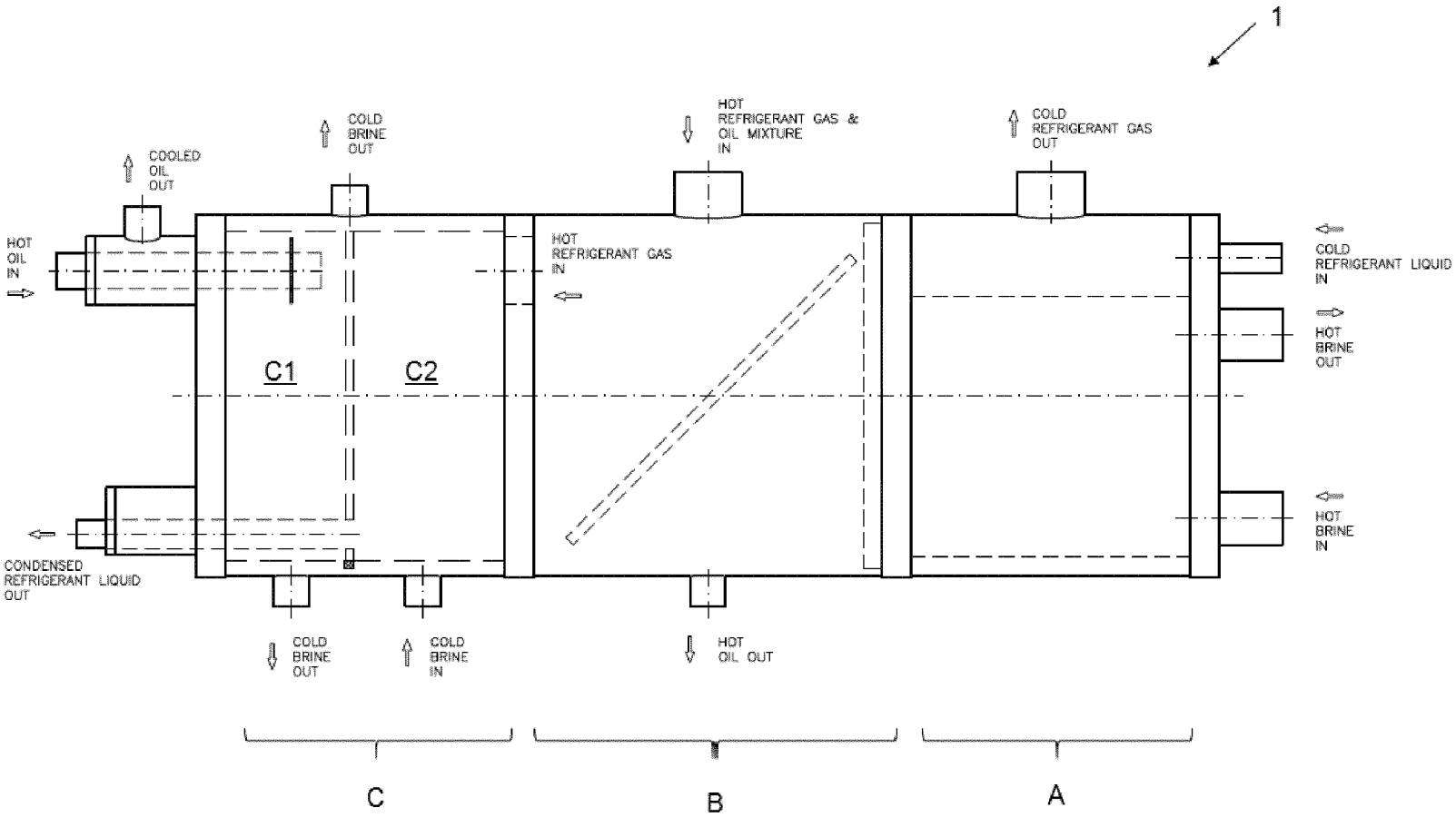
FIG. 3 shows a modular arrangement according to an exemplary embodiment of the invention for use in vapor-compression refrigeration system with the description of the flows at the system.
Figure 4:
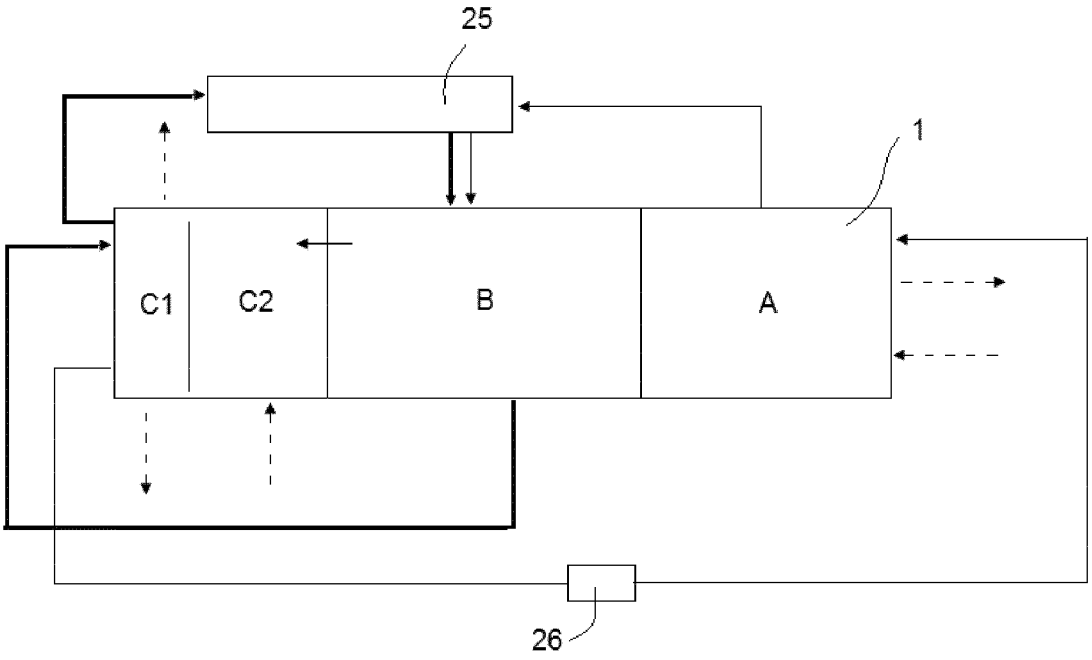
FIG. 4 shows a schematic drawing of the vapor-compression refrigeration system comprises a modular arrangement according to the invention.

FIG. 3 illustrates the flows at the system according to an embodiment of the present invention. A refrigerant to be used in the system may be ammonia. The structure of FIG. 3 is similar as presented in FIG. 2. FIG. 4 presents the basic principle of the vapor-compression refrigerating system according to the present invention. In FIG. 4, a dashed line illustrates heat exchange medium for use in heating/cooling in the heat exchangers, a thin line illustrates a flow of the refrigerant in the cycle, and a thick line illustrated a flow of oil in the cycle.

In a vapor-compression refrigeration arrangement according to an exemplary embodiment presented in FIG. 3, brine is used as heating/cooling medium in the heat exchangers of the first functional part A and the third part functional part C of the arrangement. In the arrangement of FIG. 3, liquid refrigerant is led inside the first part A of the arrangement 1 according to the present invention functioning as an evaporator. Evaporator evaporates refrigerant and refrigerant gas is led out from the first part A of the arrangement 1 according to the present invention to a compressor 25. Compressor 25 compresses refrigerant gas from the evaporator to a higher pressure, resulting a higher temperature as well. Compressor needs oil to lubricate and seal the compressor parts, the oil is mixed during the compression process with the refrigerant gas. The hot, compressed refrigerant gas is therefore led to the second part B of the arrangement 1 according to the present invention functioning as an oil separator, which is used to separate oil from hot refrigerant gas coming from compressor. The separated oil flows to the oil cooler C1 and then it is directed back to compressor 25. The hot refrigerant gas from compressor and oil separator will be condensed in condenser C2 while the cooling medium is heated. From condenser C2, the condensed refrigerant liquid continues in liquid form to the expansion device 26. Expansion device 26 lowers the pressure and then the liquid refrigerant is directed back to the first part A of the arrangement 1 according to the present invention functioning as an evaporator.

The invention claimed is:

1. An arrangement (1) suitable for use in vapor-compression refrigeration system, which comprises an evaporator, an oil separator, a condenser, and an oil cooler, wherein the evaporator, the oil separator, the condenser and the oil cooler are arranged inside an outer casing that comprises a longitudinal cylindrical shell (2) and the end plates (3, 4) arranged at both ends of the shell, and the shell comprises three separate parts (A, B, C), which are separated from each other by arranging a first partition wall (5) and a second partition wall (6) between the parts, wherein the first part (A) comprises the evaporator, the second part (B) comprises the oil separator and the third part (C) comprises the oil cooler and the condenser, and the third part (C) comprising the oil cooler and the condenser is constructed by arranging one plate pack (13) into the third part, which plate pack (13) is divided two functional plate pack parts (C1, C2) by arranging an intermediate plate (8) between the heat exchange plates of said plate pack (13), wherein the first plate pack part (C1) functioning as oil cooler and the second plate pack part (C2) functioning as the condenser.

2. The arrangement according to claim 1, wherein the longitudinal cylindrical shell (2) is uniform shell in the longitudinal direction of said shell, and the shell is divided in the longitudinal direction to three separate parts (A, B, C) by arranging the first partition wall (5) and the second partition wall (6) between the parts, wherein said partition walls (5, 6) are attached to the shell.

3. The arrangement according to claim 1, wherein the longitudinal cylindrical shell (2) is constructed from two or more parts (2*a*, 2*b*, 2*c*), wherein the shell is continuous covering at least one part (A, B, C) of the arrangement.

4. The arrangement according to claim 1, wherein the evaporator is a flooded evaporator.

5. The arrangement according to claim 1, wherein the second part (B) comprising oil separator is a central part of the longitudinal cylindrical shell (2).

6. The arrangement according to claim 1, wherein the partition walls (5, 6) are pressure-proof walls.

7. The arrangement according to claim 1, wherein the partition wall (5) between the evaporator and the oil separator further comprises an insulation layer (7).

8. The arrangement according to claim 1, wherein an inlet connection (9) for leading the refrigerant into the plate pack part (C2) functioning as condenser in the third part (C) is arranged through the partition wall (6) between the second part (B) and the third part (C), and an outlet connection for leading the condensed refrigerant out from the plate pack part (C2) functioning as condenser is arranged through the intermediate plate (8) of the plate pack (13) in the third part (C) and the outlet connection pipe (10) is arranged inside a flow passage of the first plate pack part (C1) functioning as oil cooler in the third part (C) and the outlet connection pipe (10) elongates through the end plate (4) of the outer casing.

9. The arrangement according to claim 8, wherein a refrigerant to be condensed is arranged to flow in the flow channels inside the plate pack of the plate pack part (C2).

10. The arrangement according to claim 1, wherein an inlet connection (11) of the plate pack part (C1) functioning as oil cooler in the third part (C) is arranged inside the outlet connection (12) of the plate pack part (C1) functioning as oil cooler, wherein the inlet and outlet connections (11, 12) are arranged through the same opening arranged at the end plate (4) of the outer casing.

11. The arrangement according to claim 1, wherein the first part (A) comprises a plate pack (20) functioning as a flooded evaporator, which is arranged at a lower part of the first part (A), an inlet connection (14) and an outlet connection (15) for leading the heat exchange medium into and out from the plate pack (20) functioning as an evaporator, and an inlet connection (16) for leading the refrigerant to be vaporised into the first part (A) and an outlet connection (17) for leading the vaporised refrigerant out from the first part (A).

12. The arrangement according to claim 1, wherein the second part (B) functioning as oil separator comprises an inlet connection (18) for leading refrigerant into the second part, and an outlet connection (19) for leading separated oil out from the second part.

13. The arrangement according to claim 1, wherein the diameter of the longitudinal cylindrical shell is substantially same in all parts (A, B, C) of the arrangement.

14. A vapor-compression refrigeration system, which comprises at least an arrangement (1) according to claim 1, which comprises an evaporator, an oil separator, a condenser and an oil cooler, a compressor (25), means for leading a refrigerant circulating in the system from the evaporator to the compressor, from the compressor to the oil separator and from the condenser to the evaporator, means for conveying oil from the oil separator to the oil cooler, and from the oil cooler to the compressor, and an expansion device (26) through which the refrigerant circulating in the system is lead from the condenser to the evaporator.

15. The vapor-compression refrigeration system according to claim 14, wherein the refrigerant circulating in the vapor-compression refrigeration system comprises ammonia.

16. The arrangement according to claim 2, wherein the evaporator is a flooded evaporator.

17. The arrangement according to claim 3, wherein the evaporator is a flooded evaporator.

18. The arrangement according to claim 2, wherein the second part (B) comprising oil separator is a central part of the longitudinal cylindrical shell (2).

19. The arrangement according to claim 3, wherein the second part (B) comprising oil separator is a central part of the longitudinal cylindrical shell (2).

20. The arrangement according to claim 4, wherein the second part (B) comprising oil separator is a central part of the longitudinal cylindrical shell (2).

* * * * *